US006196601B1

(12) United States Patent
Juntunen, Jr.

(10) Patent No.: US 6,196,601 B1
(45) Date of Patent: Mar. 6, 2001

(54) PET WASTE RETRIEVER

(76) Inventor: Donald L. Juntunen, Jr., 106 Juntunen La., Longview, WA (US) 98632

( * ) Notice: Subject to any disclaimer, the term of this patent is extended or adjusted under 35 U.S.C. 154(b) by 0 days.

(21) Appl. No.: 09/589,486

(22) Filed: Jun. 7, 2000

(51) Int. Cl.[7] ..... A01K 29/00; E01H 1/12
(52) U.S. Cl. ..... 294/1.4
(58) Field of Search ..... 294/1.3, 1.4, 1.5, 294/19.1, 50.7, 50.8, 99.1, 100, 115, 116; 15/104.8, 257.1, 257.6, 257.7; 119/161

(56) References Cited

U.S. PATENT DOCUMENTS

| | | | | |
|---|---|---|---|---|
| 3,446,525 | | 5/1969 | Jones . | |
| 3,819,220 | * | 6/1974 | Bredt | 294/1.5 |
| 3,929,363 | * | 12/1975 | Kahan | 294/1.4 |
| 4,021,068 | | 5/1977 | Piazza . | |
| 4,056,278 | | 11/1977 | Bau . | |
| 4,078,838 | | 3/1978 | Nadratowski . | |
| 4,179,145 | | 12/1979 | Shinsako . | |
| 4,225,169 | | 9/1980 | DeToma . | |
| 4,253,691 | | 3/1981 | Liu . | |
| 4,286,816 | | 9/1981 | Tobias . | |
| 4,477,111 | | 10/1984 | Crooks . | |
| 4,819,977 | * | 4/1989 | Cooper | 294/1.4 |
| 4,995,661 | * | 2/1991 | Aurness | 294/1.4 |
| 5,335,952 | | 8/1994 | Clapper . | |
| 5,562,319 | | 10/1996 | Kohler . | |

* cited by examiner

*Primary Examiner*—Johnny D. Cherry
(74) *Attorney, Agent, or Firm*—Brian J. Coyne

(57) ABSTRACT

A device for manual retrieval of solid pet waste. A funnel-shaped body is mounted on a shaft fitted with a handle. A plurality of ribs have first ends pivotally attached to a ring that is slidable along the shaft, and have opposite ends attached to a pair of jaws. Adjacent portions of the jaws are joined by flexible walls. A collar is slidably mounted on the shaft between the handle and the ring. For each rib, a straight, rigid strut is pivotally attached at one end to the collar and at an opposite end to an intermediate portion of the rib. A spring interposed between the collar and the ring urges the ring away from the collar. The jaws are slidable within the housing between a closed, retracted position and an open extended position. A button and catch arrangement is provided for reversibly locking and unlocking the collar and the jaws in the retracted position. A disposable bag is provided for placement over and around the jaws. With the jaws extended and spread apart over solid pet waste, a one-handed, downard thrust of the retriever closes and retracts the jaws, capturing the waste within the bag.

10 Claims, 10 Drawing Sheets

PET WASTE RETRIEVER

CROSS REFERENCE TO RELATED APPLICATIONS

Not applicable.

STATEMENT REGARDING FEDERALLY APPROVED RESEARCH OR DEVELOPMENT

Not applicable.

BACKGROUND OF THE INVENTION

1. Field of the Invention

This invention relates to devices and methods for picking up solid wastes of dogs and other kinds of pets, and, more particularly, to manual devices for grasping and enclosing pet waste within a disposable bag.

2. Background Art

City and town ordinances commonly require that pet owners remove solid wastes deposited by their pets in public places. In addition to being unpleasant, the task can be especially cumbersome for a pet owner who tries to control a pet restrained by a leash held in one hand, while simultaneously attempting to retrieve the pet waste with the opposite hand. Prior to my invention, manual devices capable of retrieving and bagging pet solid waste were known and were capable of making the task somewhat less unpleasant. See, for example, U.S. Pat. No. 5,562,319 to Kohler; U.S. Pat. No. 4,477,111 to Crooks; U.S. Pat. No. 4,286,816 to Tobias; U.S. Pat. No. 4,253,691 to Liu; U.S. Pat. No. 4,078,838 to Nadratowsky; and U.S. Pat. No. 3,446,525 to Jones. But, to simplify the task and make it less cumbersome, what is needed is a device that can be held and operated with one hand only, and that will grasp solid pet waste and enclose it within a disposable bag—all with only a single, quick, downward motion of that same hand—thereby freeing up the other hand for restraining the pet, if need be. The present invention fulfills that need by providing a device with a pair of jaws within a truncated, conical body and a disposable bag mountable between the jaws, such that, with the jaws spaced apart and extended outward from the body, a single movement of the device downward onto pet waste causes the body to slide over the jaws and the jaws to close around the bag, thereby entrapping the waste within the bag.

U.S. Pat. No. 5,335,952 to Clapper disclosed a device having a pair of jaws or scoop members made of outwardly-biased, springy material, and carried on the distal end of an elongated shaft. The scoop members were placed within a hollow sleeve, having a pair of opposed side walls, and open at both ends. In use, the scoop members were advanced out of the lower end of the sleeve and permitted to move apart, a bag was placed over the scoop members, and the scoop members and bag were placed over solid pet waste. With the handle in one hand, the opposite hand moved the sleeve downward over the scoop members, thereby turning the bag inside-out and closing the bag around the waste. To eject and discard the bag, the scoop members were again advanced outside of the sleeve and the bag removed from the scoop members. Thus, the simultaneous use of both hands was required to use Clapper's device.

The present invention incorporates a rib assembly for attaching the jaws to the body that is slidable within the body between an extended and a retracted position. The rib assembly includes a collar mounted for sliding movement on an axial shaft that carries a handle at one end. A plurality of ribs, similar to umbrella ribs, are pivotally attached to the collar and extend away from the handle to the jaws, such that movement of the collar away from the handle permits the ribs and jaws to spread apart, whereas, retraction of the collar back toward the handle corresponds to the jaws clamping shut. U.S. Pat. No. 4,225,169 to DeToma disclosed a device having an elongated shaft, comprised of two telescopically slidable members—an outer member surrounding an inner member that carried a handle at one end—that actuated a mechanical hand similar to the assembly of umbrella ribs. The mechanical hand was composed of a spider-like array of thread-like fingers that were resiliently flexible and which diverged from the distal end of the internal member of the shaft. In use, a baglike, disposable container was placed over distal ends of the ribs, the mechanical hand with attached container was placed over solid pet waste, and, holding the outer member stationary with one hand, the inner member was pushed toward the waste by the opposite hand's pressing downward on the handle to force the hand and bag to close about and envelope the waste. Thus, DeToma's device also required the simultaneous use of both hands.

SUMMARY

Accordingly, there remains a need for a portable pet waste retriever that can gather up solid pet waste into a disposable bag and that requires only one hand to operate. Such a retriever is provided, comprising a hollow, funnel-shaped body that houses a shaft, a rib assembly mounted on the shaft, and a jaw assembly attached to the rib assembly. The body extends axially along an axis A—A from a first, open end having a first, relatively small diameter, to a second, open end having a second, relatively large diameter, thereby defining a first, substantially cylindrical portion and a second, truncated conical portion. The shaft has a first end and an opposite, second end, and extends along axis A—A from the first end of the body into the interior of the second, truncated, conical portion of the body. A handle is attached to the first end of the shaft.

The rib assembly includes an annular ring mounted for sliding movement on the shaft between the handle and the second end thereof. A plurality of ribs is provided. The ribs have first ends pivotally attached to the ring at circumferentially spaced-apart intervals thereon. Each rib extends from the ring in a direction that diverges from axis A—A and away from the handle toward an opposite, second, distal end. The rib assembly further includes spreader means mounted on the shaft between the handle and the ring for urging the first ends of the ribs axially away from the handle and for spreading the distal ends of the ribs radially outward from the axis A—A.

The jaw assembly includes a pair of jaws oppositely disposed about axis A—A and attached to the distal ends of the ribs. The jaws are slidable between a first, axially and radially retracted position and a second, axially and radially, extended position. Each of the jaws comprises substantially one-half of a hollow, truncated cone. The jaw assembly further includes a pair of oppositely-disposed, flexible walls that extend between and join adjacent portions of the jaws. The walls may be of cloth, such as that used in umbrellas. The jaws preferably include a pair of oppositely-disposed and oppositely-directed, substantially semicircular disks, each disk being attached to a distal end of a jaw. To prevent rotation of the jaw assembly with respect to the body, each of the jaws has an axially extended slot, the body has a pair of oppositely-disposed openings in registry with the slots, and a pin is inserted through the openings and through the slots.

The spreader means preferably includes a collar slidably mounted on the shaft between the handle and the ring. The collar has a first end and an opposite, second, distal end. For each rib, a strut is provided having a first end pivotally attached to the collar and an opposite, second end pivotally attached to an intermediate portion of the rib. A spring is interposed between the collar and the ring for urging the ring axially away from the collar. Manual means is provided for reversibly locking the jaw assembly in the retracted position. For this purpose, the collar has an aperture, and the manual means includes a spring-biased, manually depressible tab pivotally attached to the first end of the shaft and disposed for reversible insertion into, and withdrawal from, the aperture.

Disposable bags for use with the retriever are also provided. Each bag is of suitable size and shape to extend across and cover the jaws when the jaw assembly is in its extended, jaws-spread-apart, position. Preferably, the bags are made of biodegradable material. To ready the retriever for use, the tab is depressed out of the aperture, thereby permitting the spreader means to cause the collar, ribs and jaws to spring forward and spread apart; a disposable bag is installed on the jaws, and the jaws are then pushed into the body and shut. When solid waste is to be retrieved, the jaws are again extended and opened by depressing the tab, and the retriever is forced downward with one hand onto the waste, bag end first. With continued downward motion of the same hand, the jaws are forced back into the body and shut around the bag and the waste (i.e., into the retracted position), while the tab reinserts inside the aperture and into locked condition. When a suitable waste receptacle is reached, the tab is again depressed, opening the jaws, and the bag of waste is removed and discarded.

BRIEF DESCRIPTION OF THE DRAWINGS

Like reference numerals indicate corresponding parts throughout the several figures. The term "radial" will be understood to refer to a direction that is radial with respect to axis A—A, as shown, for example, by arrow R in FIG. 1.

DETAILED DESCRIPTION OF THE PREFERRED EMBODIMENT

Figure 1:
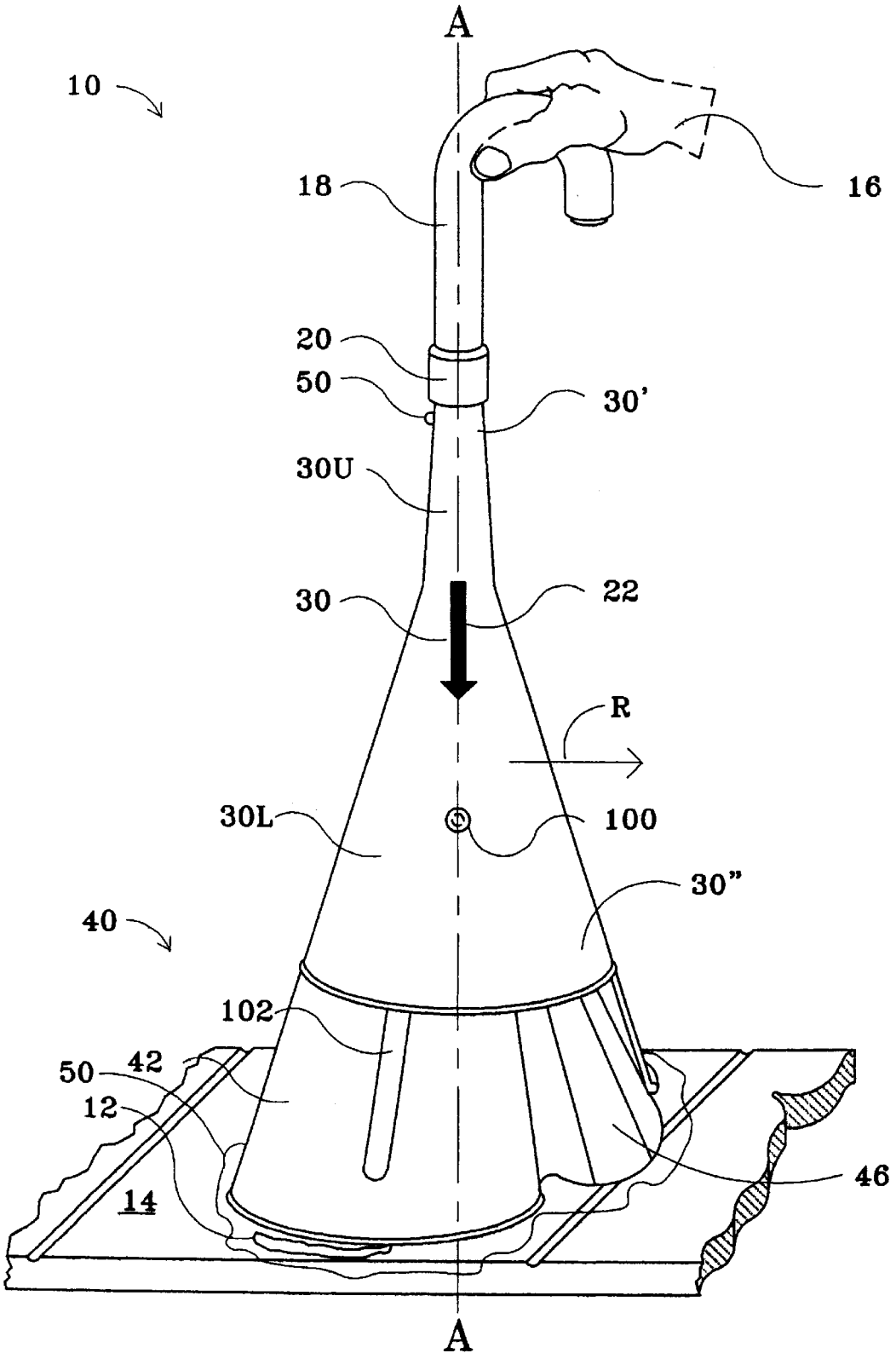
FIG. 1 is a side perspective view of the pet waste retriever with jaw assembly in open, extended position, showing the retriever being held by one hand over pet waste and being thrust downward toward the waste.
Figure 3:
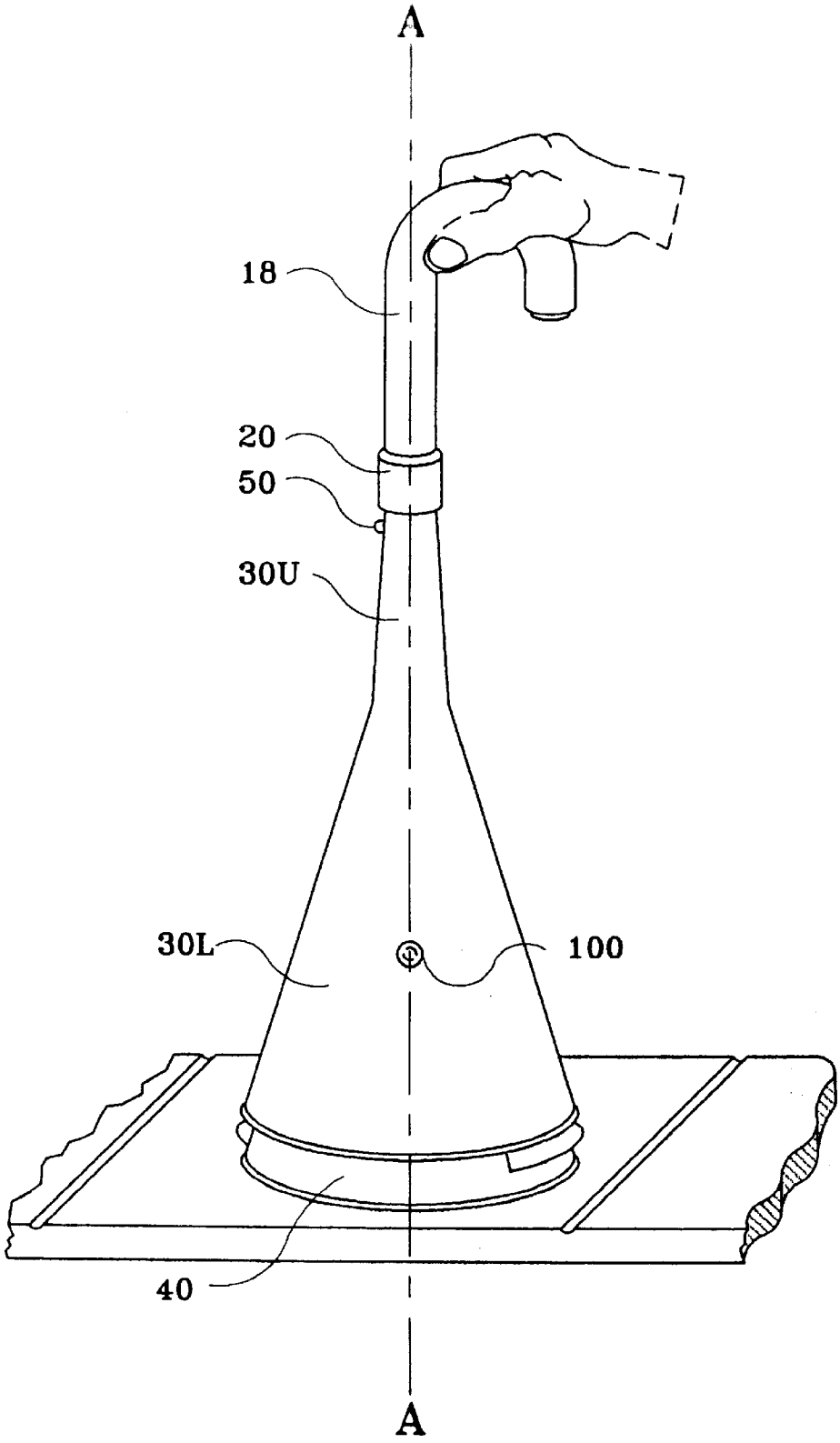
FIG. 3 is a side perspective view thereof a moment later, showing the jaw assembly now in retracted position and closed about the waste.
Figure 4:
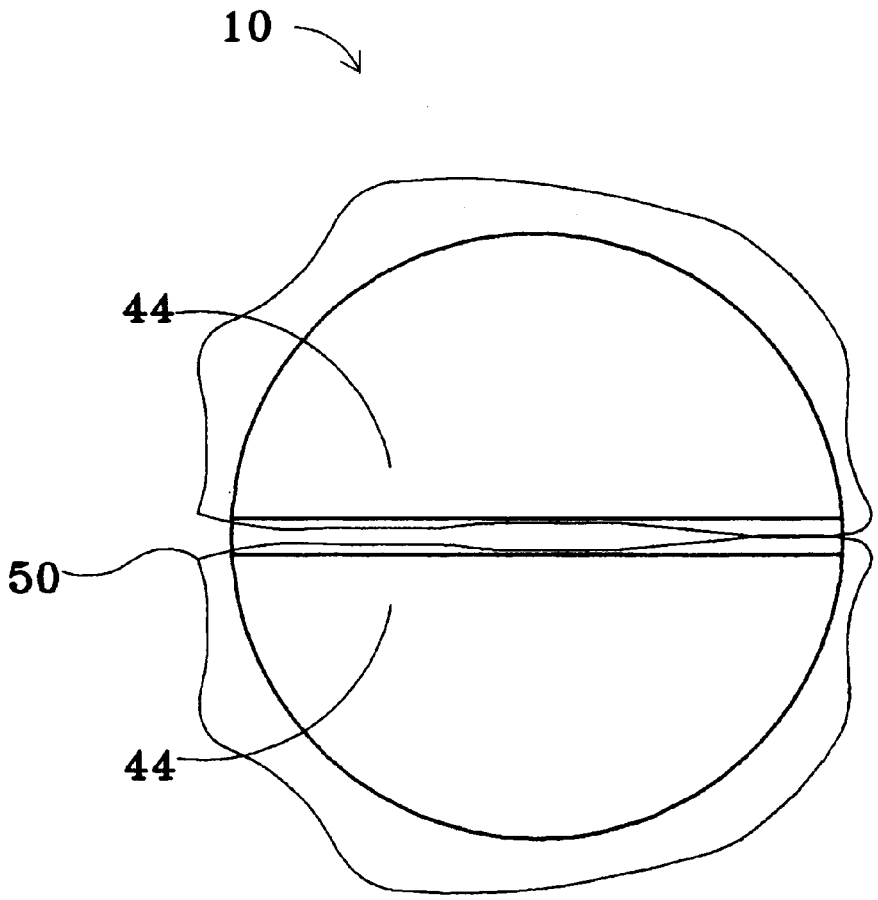
FIG. 4 is a bottom view thereof.
Figure 5:
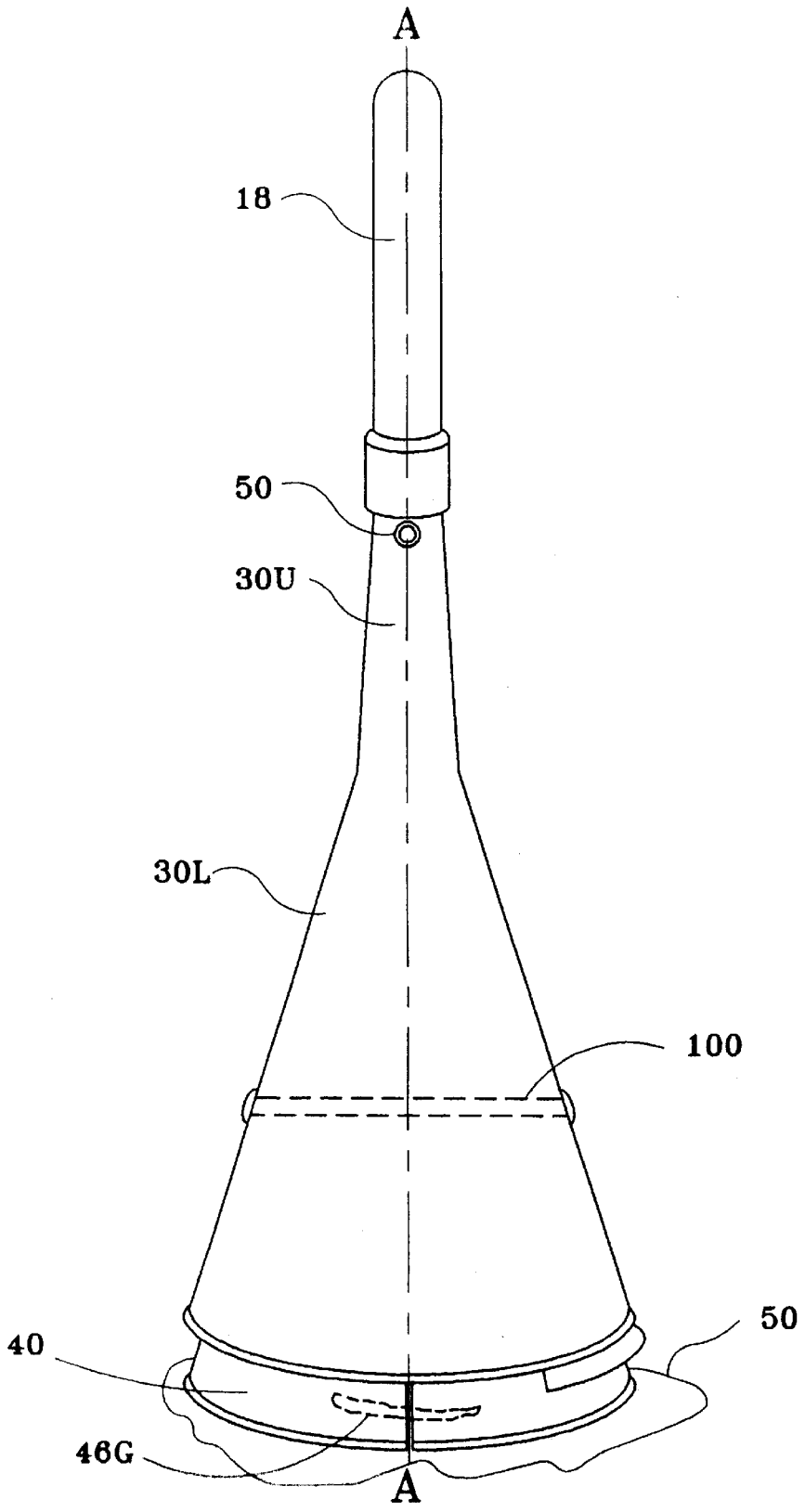
FIG. 5 is a front elevational view of the retriever with jaw assembly in retracted position, showing the antirotation pin in phantom outline.

FIG. 1 depicts a preferred embodiment of my retriever 10 being used to retrieve solid pet waste 12 deposited on a sidewalk surface 14. A hand 16 grasps a handle 18 having a hollow fitting 20 into which is inserted the upper, first end 30' of a hollow, funnel-shaped body 30. The body 30 has a first, upper portion 30U that is substantially cylindrical and axially elongated along an axis A—A, and a second, lower portion 30L that has the shape of a truncated cone aligned on axis A—A and terminating in a second end 30". The diameter of the second end 30" is substantially greater than the diameter of the first end 30', preferably four to six times greater. The retriever 10 is being thrust downward, as indicated by arrow 22, toward the waste 12. The retriever's jaw assembly, indicated generally by the numeral 40, is in an open, extended position, with the jaws 42 thereof spaced apart, as may best be seen in FIG. 2. A clear plastic, disposable bag 50 has been placed around and over the jaws 42 for receiving the waste 12. With further downward thrust of the retriever 10, the jaw assembly 40 engages the sidewalk surface 14 and the body 30 thereafter slides down around the jaw assembly 40, thereby forcing the jaws 42 together into closed and locked position around the bag 50 and the waste, as shown in FIGS. 3 and 4. The retriever 10 is then carried to a suitable waste disposal receptacle, the retriever 10 is opened by depressing release button 50, which permits the jaw assembly 40 to spring out of the body 30 into the open, extended position, the bag 50 is removed and discarded, and the jaw assembly 40 is then manually pushed back into the retracted, locked position within the body 30.

Figure 2:
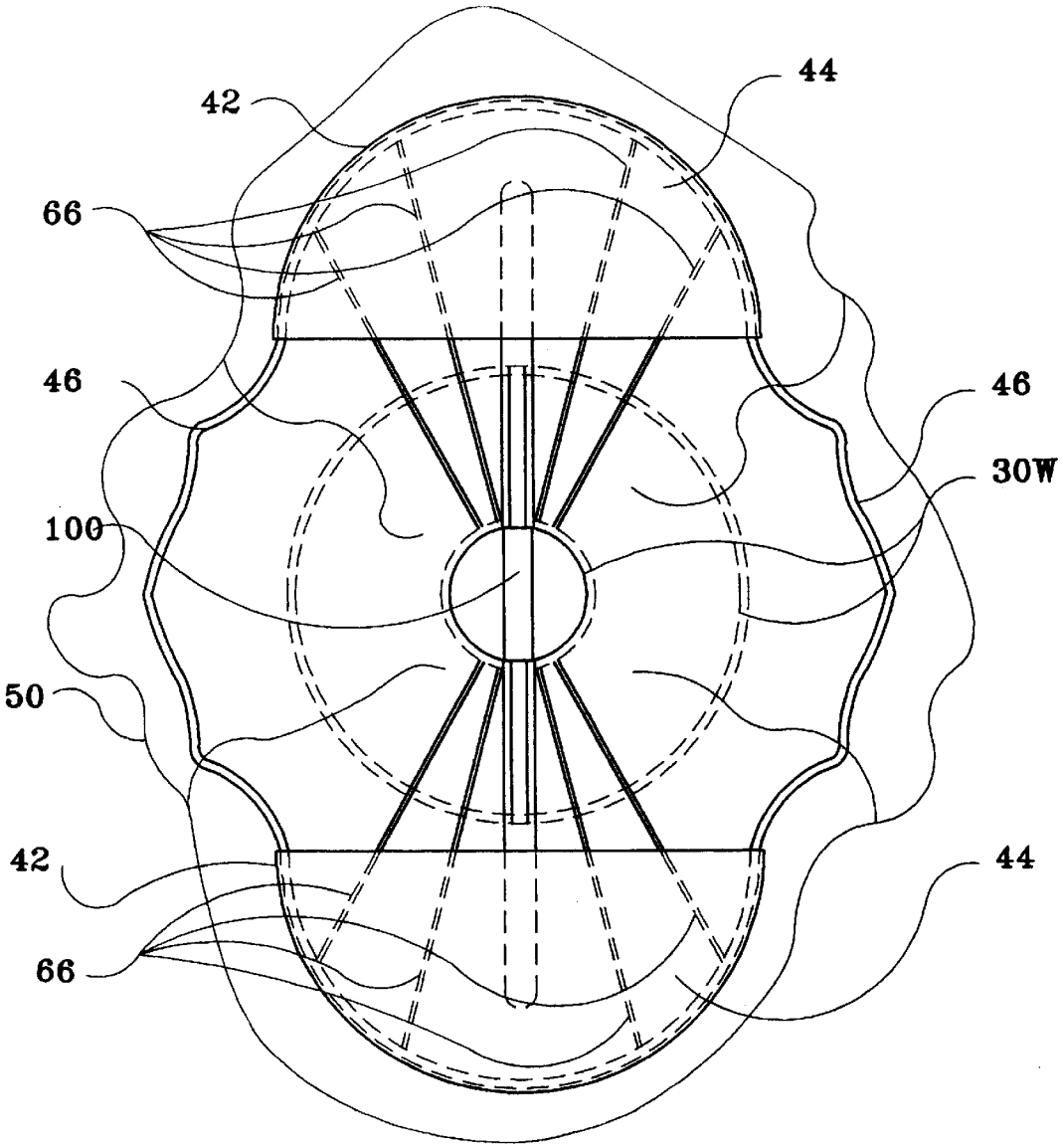
FIG. 2 is a bottom view thereof.
Figure 10:
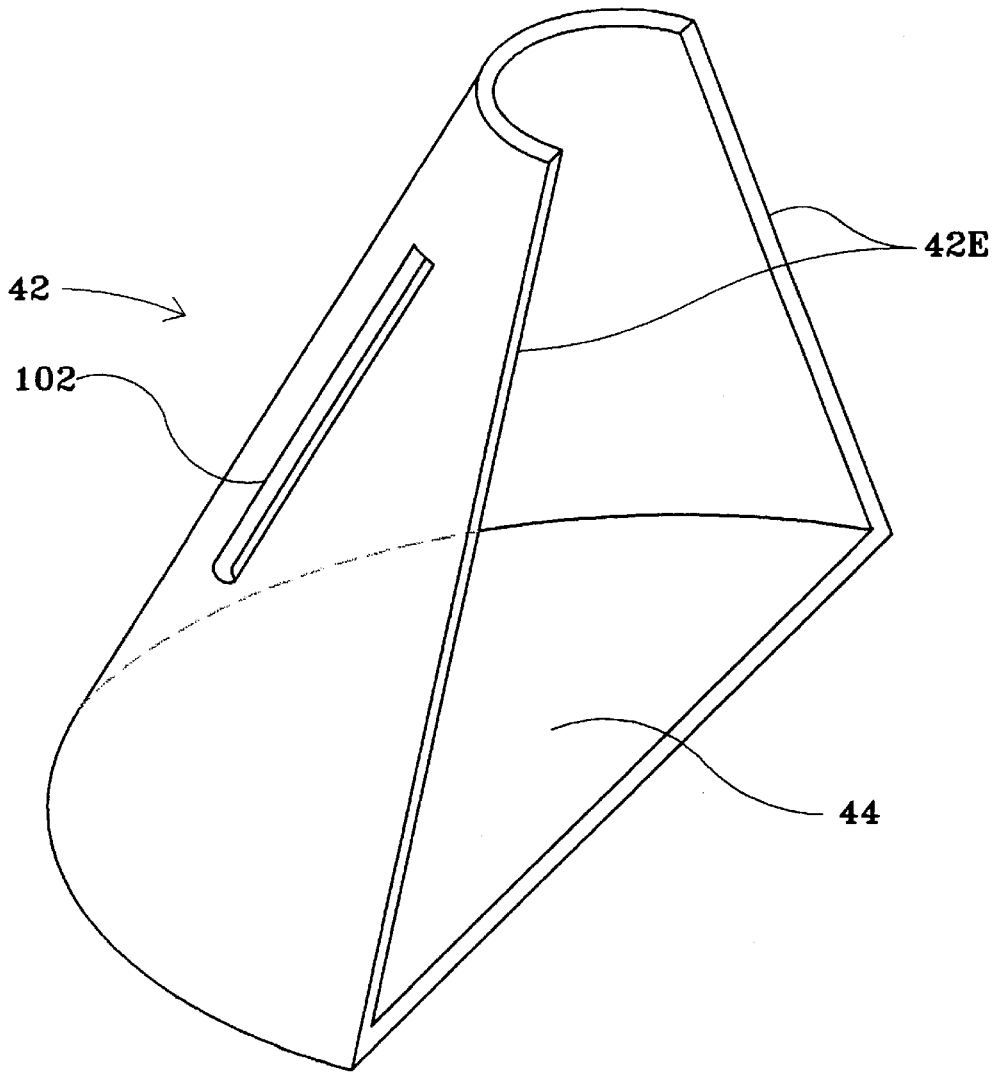
FIG. 10 is a perspective view of one jaw and semicircular disk, removed from the retriever.

Referring now to FIGS. 1, 2, and 10, it may be seen that the jaw assembly 40 includes a pair of jaws 42 that are oppositely and symmetrically disposed about axis A—A within the second, lower portion 30L of the body 30 and partially extending outward thereof through second end 30". Each jaw 42 comprises substantially one-half of a hollow, truncated cone, sized and shaped for smooth sliding engagement with the interior wall 30W of the lower portion 30L of the body 30. A semicircular disk 44 is attached to and covers the lower end of each jaw 42 such that the disks 44 are in closed, mating engagement when the jaw assembly 40 is in the retracted position. The jaw assembly 40 further includes a pair of flexible walls 46 that are oppositely and symmetrically disposed about axis A—A, each flexible wall 46 joining opposite and adjacent edges 42E of the jaws 42. The flexible walls 46 are folded into gathers 46G when the jaw assembly 40 is in the retracted position, in the manner of umbrella cloth in a folded umbrella, and the gathers 46G unfold when the jaw assembly 40 is moved into the open, extended position, as depicted in FIGS. 1 and 2.

A shaft 60 carries the handle 18 at a first end 60' and extends along axis A—A to a second, opposite end 60" within the lower portion 30L of the body 30. A rib assembly 62 mounts the jaw assembly 40 to the shaft 60 for sliding movement between the retracted and the extended positions. The rib assembly 62 includes a ring 64 mounted for sliding movement on the shaft 60 between the handle 18 and the second end thereof 60"; two sets of ribs, each set comprising three ribs 66 oppositely and symmetrically disposed about axis A—A, each rib 66 having a first end pivotally attached to the ring 64 at circumferentially spaced apart intervals thereon, each rib 66 extending from the ring 64 in a direction that diverges from axis A—A and away from the handle 18 toward an opposite, second, distal end; and spreader means 70 mounted on the shaft 60 between the handle 18 and the ring 64 for urging the first ends of the ribs 66 axially away from the handle 18 and for spreading the distal ends of the ribs 66 radially outward from the axis A—A. The distal ends of the ribs 66 are attached to interior surfaces of the jaws 42, as shown in phantom outline in FIG. 2.

Figure 6:
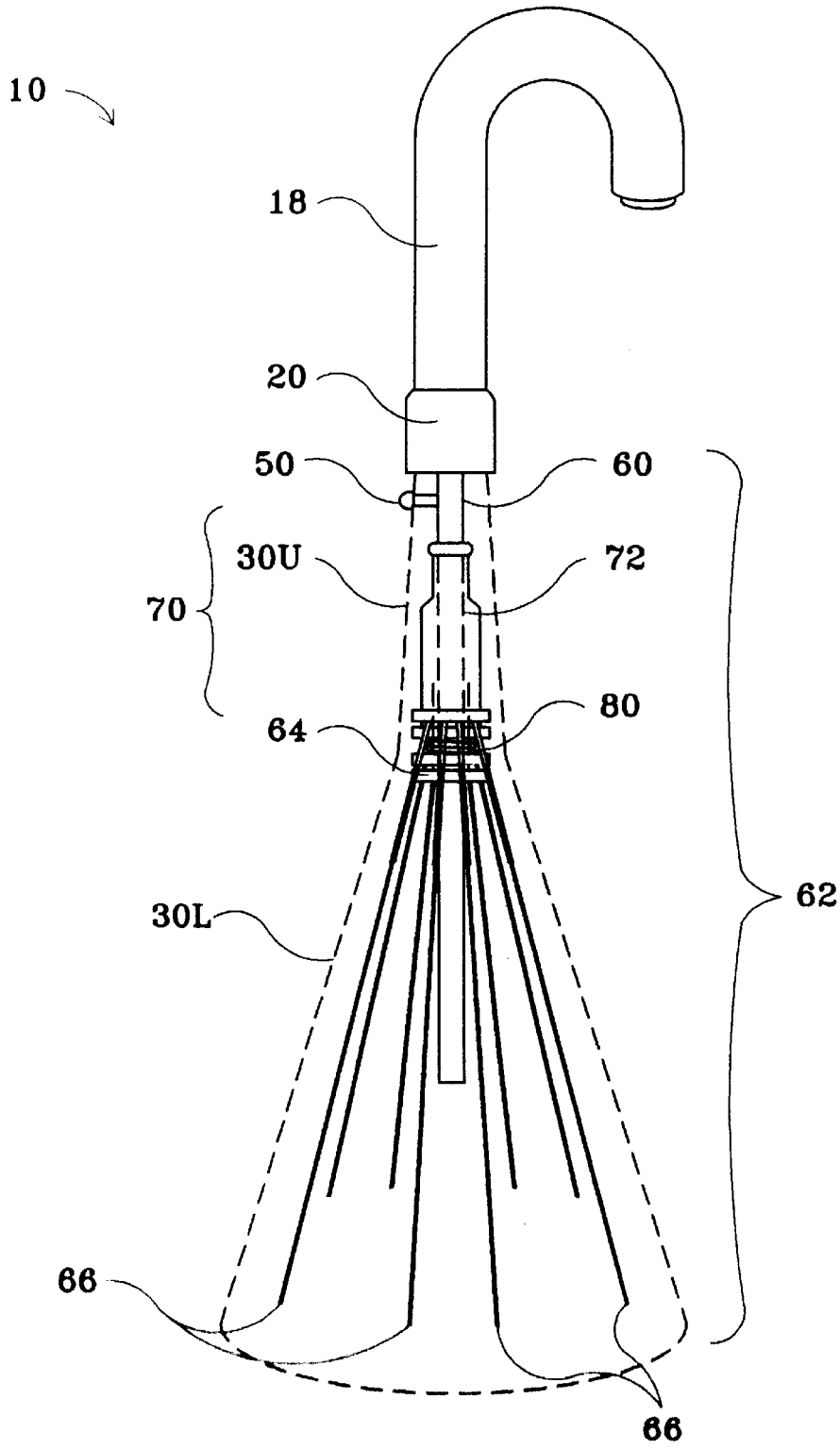
FIG. 6 is a side perspective view of the retriever in retracted position, with the body and jaw assembly removed for clarity.
Figure 7:
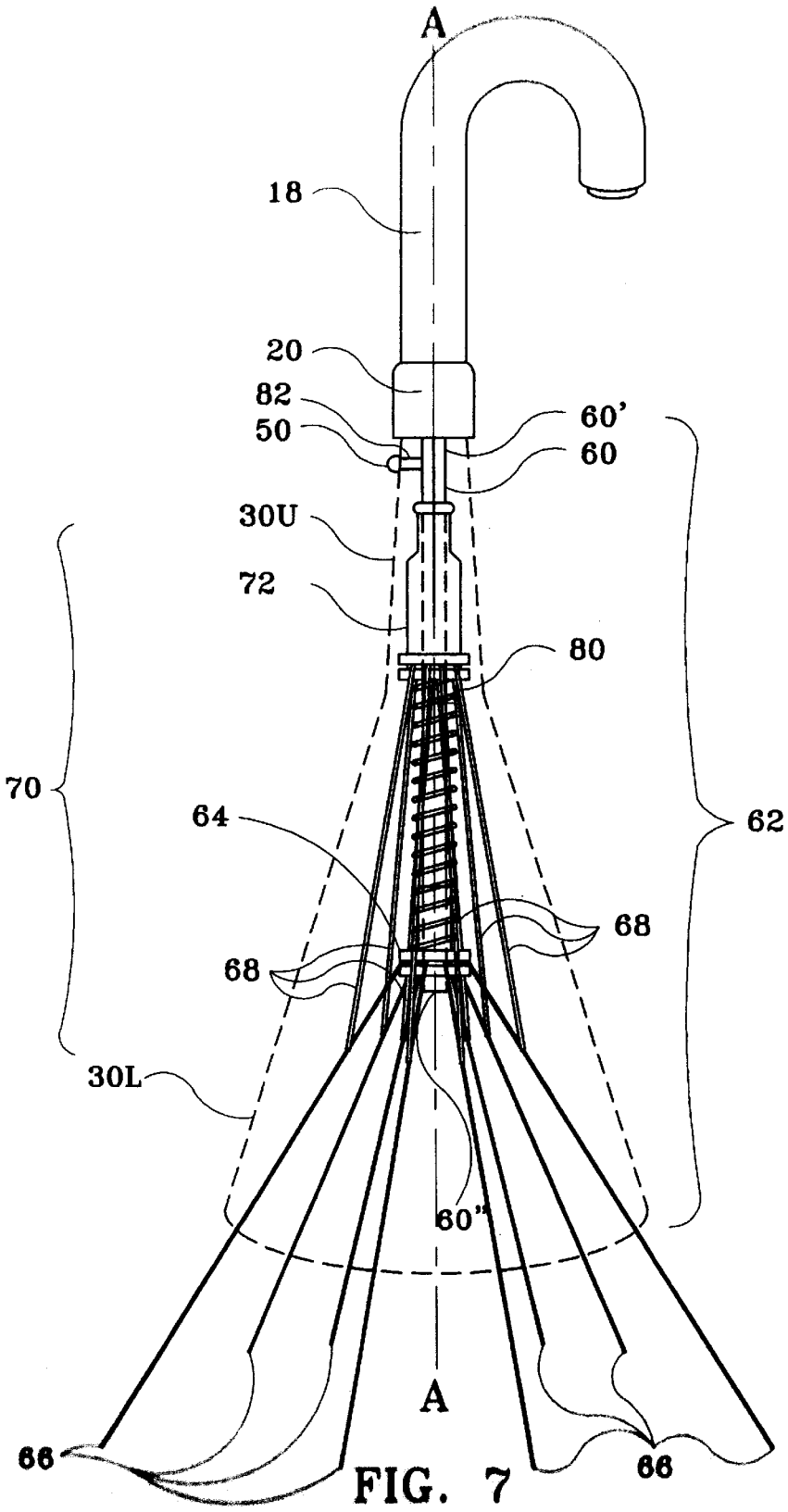
FIG. 7 is the same view, but with the retriever in extended position and ribs spread apart.
Figure 8:
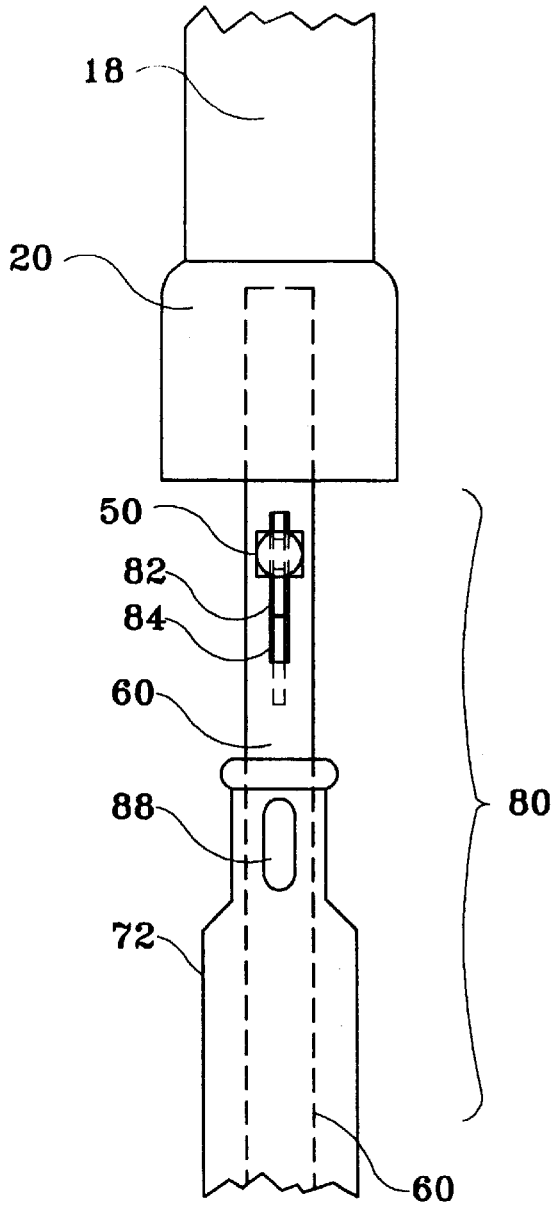
FIG. 8 is an enlarged, fragmentary, front elevational view thereof, showing the spring-biased, manually depressible button and catch for locking the jaw assembly in the retracted position.
Figure 9:
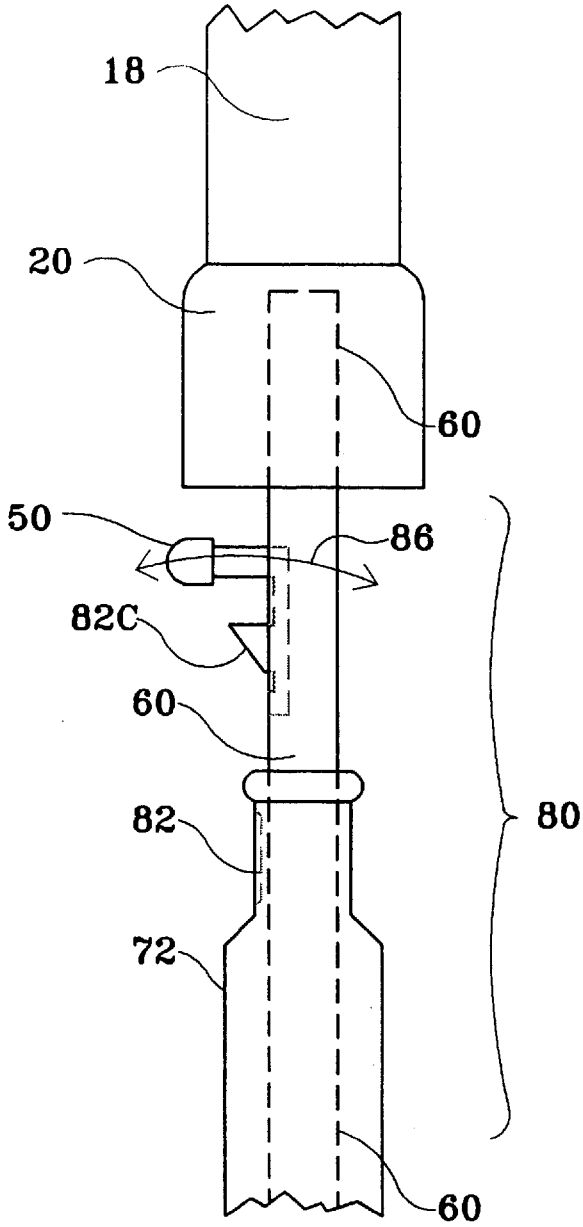
FIG. 9 is a side elevational view thereof.

In a preferred embodiment, the spreader means 70 includes an axially-extended collar 72 slidably mounted on the shaft 60 and, for each rib 66, a straight, rigid strut 68 having a first end pivotally attached to the collar 72 and an opposite, second end pivotally attached to an intermediate portion of the rib 66; see FIGS. 6 and 7. The spreader means 70 further includes a coil spring 80 mounted on the shaft 60 and interposed between the collar 72 and the ring 64 for urging the ring 64 axially away from the collar 72. Thus, when the jaw assembly 40 is in a fully closed, retracted position, the spring 80 is compressed (FIG. 6), whereas, when the jaw assembly 40 is in an open, extended position, the spring 80 is decompressed (FIG. 7).

Referring to FIGS. 5–9, manual means 80 is provided for locking the jaw assembly 40 in the closed, retracted position. The manual means 80 includes a spring-biased, manually depressible tab and lever 82 pivotally attached to the first end 60' of the shaft 60; the tab 82 is disposed, and radially displaceable, within an axially elongated slot or recess 84 therein, as shown by arrow 86. The tab 82 carries a button 50 and has a radially projecting catch 82C adjacent to the button 50. The collar 72 has an axially-extended aperture 88 for receiving and retaining the catch 82C when the jaw assembly 40 is in the fully closed, retracted position.

If the shaft 60 has a round radial cross section, it is necessary to include means to prevent rotation of the jaw assembly around the shaft 60. Accordingly, an antirotation pin 100 extends radially through the lower portion 30L of the body 30 just below the second end 60" of the shaft 60 and through axially elongated slots 102 in each of the jaws. The slots 102 permit the jaw assembly 40 to move radially and axially between the retracted and the extended positions, while at the same time constraining the jaw assembly 40 from rotating around the shaft 60. Alternatively, the shaft 60 could have a rectangular cross-section instead (not shown), and the ring 64 and collar 72 could be provided with mating rectangular interior cross-sections (not shown).

The handle 18, jaws 42, semicircular disks 44, button 50, ring 64, and collar 72 are preferably made of rigid plastic; the shaft 60, ribs 66, struts 68 and tab 82 are preferably made of aluminum. The bag 50 is preferably made of any one of a variety of biodegradable substances such as are known to persons of ordinary skill in the art. Various changes and modifications will become obvious to those skilled in the art. It is the intent that these changes and modifications are to be encompassed within the spirit of the appended claims and that the invention described herein and shown in the accompanying drawings are illustrative only and not intended to limit the scope of the invention.

I claim:

1. A pet waste retriever, comprising:

a hollow, funnel-shaped body, said body extending axially along an axis A—A from a first, open end having a first, relatively small diameter, to a second, open end having a second, relatively large diameter, thereby defining a first, substantially cylindrical portion and a second, truncated conical portion;

a shaft having a first end and an opposite second end, said shaft extending along axis A—A from said first end of said body into the interior of the second, truncated conical portion of said body;

a handle attached to the first end of the shaft;

a rib assembly, including an annular ring mounted for sliding movement on the shaft between the handle and the second end thereof;

a plurality of ribs having first ends pivotally attached to the ring at circumferentially spaced-apart intervals thereon, each rib extending from said ring in a direction that diverges from axis A—A and away from the handle toward an opposite, second, distal end; and spreader means mounted on the shaft between the handle and the ring for urging the first ends of the ribs axially away from the handle and for spreading the distal ends of the ribs radially outward from the axis A—A;

a jaw assembly, including a pair of jaws oppositely and symmetrically disposed about axis A—A and attached to the distal ends of the ribs of said rib assembly for slidable movement within the truncated conical portion of the body between a first, axially and radially retracted, position and a second, axially and radially, extended position, each of said jaws comprising substantially one-half of a hollow, truncated cone; and a pair of flexible walls oppositely and symmetrically disposed about the axis A—A, said walls extending between and joining adjacent portions of said jaws.

2. The retriever of claim 1, wherein the jaw assembly further includes a pair of oppositely and symmetrically disposed, substantially semicircular disks, each disk being attached to a covering a distal end of a jaw.

3. The retriever of claim 2, further comprising means to prevent rotation of the jaw assembly with respect to the body.

4. The retriever of claim 3, wherein each of the jaws has an axially extended slot, the body has a pair of oppositely disposed openings in registry with said slots, and the means to prevent rotation of the jaw assembly with respect to the body is a pin inserted through said openings and through said slots.

5. The retriever of claim 4, wherein said walls are cloth.

6. The retriever of claim 5, wherein the spreader means includes a collar slidably mounted on the shaft between the handle and the ring;

for each rib, a strut having a first end pivotally attached to the collar and an opposite, second end pivotally attached to an intermediate portion of the rib; and a spring interposed between the collar and the ring for urging the ring axially away from the collar.

7. The retriever of claim 1, 2, 3, 4, 5, or 6, further comprising manual means for reversibly locking the jaw assembly in said first, axially and radially, retracted position.

8. The retriever of claim 7, wherein the collar has an axially-extended aperture and said manual means includes a spring-biased, manually depressible tab pivotally attached to the first end of the shaft and disposed for reversible insertion into, and withdrawal from, said aperture.

9. The retriever of claim 7, further including a disposable bag adapted to extend across and cover said jaws when the jaw assembly is in its second, extended position.

10. The retriever of claim 9, wherein the bag is made of biodegradable material.

* * * * *